US009211707B2

(12) United States Patent
Fujita et al.

(10) Patent No.: US 9,211,707 B2
(45) Date of Patent: Dec. 15, 2015

(54) METHOD FOR MANUFACTURING INKJET RECORDING HEAD

(71) Applicant: CANON KABUSHIKI KAISHA, Tokyo (JP)

(72) Inventors: Hirohisa Fujita, Saitama (JP); Shuji Koyama, Kawasaki (JP); Hiroyuki Abo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 13/655,796

(22) Filed: Oct. 19, 2012

(65) Prior Publication Data

US 2013/0097861 A1 Apr. 25, 2013

(30) Foreign Application Priority Data

Oct. 21, 2011 (JP) ..... 2011-232040

(51) Int. Cl.

| | |
|---|---|
| ***B21D 53/76*** | (2006.01) |
| ***B41J 2/15*** | (2006.01) |
| ***B41J 2/14*** | (2006.01) |
| ***B41J 2/16*** | (2006.01) |

(52) U.S. Cl.

CPC ..... *B41J 2/14032* (2013.01); *B41J 2/1603* (2013.01); *B41J 2/1628* (2013.01); *B41J 2/1631* (2013.01); *B41J 2/1639* (2013.01); *B41J 2/1645* (2013.01); *Y10T 29/49401* (2015.01)

(58) Field of Classification Search

CPC ..... B41J 2/1623; B41J 2202/20; Y10T 29/49401

USPC ..... 29/890.1; 347/40

See application file for complete search history.

(56) References Cited

U.S. PATENT DOCUMENTS

| | | | | |
|---|---|---|---|---|
| 4,894,664 | A * | 1/1990 | Tsung Pan | 347/63 |
| 4,922,265 | A * | 5/1990 | Pan | 347/47 |
| 6,019,457 | A * | 2/2000 | Silverbrook | 347/65 |
| 6,234,608 | B1 * | 5/2001 | Genovese et al. | 347/54 |
| 6,431,687 | B1 * | 8/2002 | Wuu et al. | 347/64 |
| 6,494,566 | B1 * | 12/2002 | Kishino et al. | 347/70 |
| 6,533,399 | B2 * | 3/2003 | Lee et al. | 347/61 |
| 7,325,310 | B2 * | 2/2008 | Kim | 29/890.1 |
| 7,334,335 | B2 * | 2/2008 | Shin et al. | 29/890.1 |
| 2003/0081072 | A1 * | 5/2003 | Trueba | 347/63 |

FOREIGN PATENT DOCUMENTS

| | | | |
|---|---|---|---|
| JP | H05-330066 | A | 12/1993 |
| JP | 2006-150900 | A | 6/2006 |
| JP | 2006150900 | * | 6/2006 |
| JP | 2010-253936 | A | 11/2010 |

* cited by examiner

*Primary Examiner* — David Angwin

(74) *Attorney, Agent, or Firm* — Canon USA, Inc. IP Division

(57) ABSTRACT

A method for manufacturing an inkjet recording head includes preparing a substrate having a mold to become an ink flow passage and an orifice layer covering the mold, and immersing the substrate in a solvent, whereby in immersing the substrate in the solvent, the mold at the substrate immersed in the solvent is irradiated with deep-UV light.

5 Claims, 5 Drawing Sheets

METHOD FOR MANUFACTURING INKJET RECORDING HEAD

BACKGROUND OF THE INVENTION

1. Field of the Invention

The present invention relates to a method for manufacturing an inkjet recording head.

2. Description of the Related Art

For example, an inkjet recording head that performs inkjet recording by discharging ink is produced by the following method.

First, a mold to become an ink flow passage is formed by applying a positive photosensitive resin onto a substrate having ink-discharge-energy generating elements and exposing and developing the positive photosensitive resin. Next, an orifice layer including ink discharge ports is formed by applying a negative organic resin onto the formed mold and exposing and developing the negative organic resin. Further, an ink supply port is formed in the substrate, and the mold is removed from the ink supply port by using solvent to form an ink flow passage.

Japanese Patent Laid-Open No. 2006-150900 describes that a mold is irradiated with deep-UV light before being removed by the solvent in such a method for manufacturing an inkjet recording head. According to this method, high-molecular components in the mold are turned into low-molecular components, and therefore, the mold is effectively removed by the solvent.

SUMMARY OF THE INVENTION

The present invention provides a method for manufacturing an inkjet recording head that solves the above problems.

A method for manufacturing an inkjet recording head according to an aspect of the present invention includes preparing a substrate having a mold to become an ink flow passage and an orifice layer covering the mold; and immersing the substrate in a solvent. In immersing the substrate in the solvent, the mold at the substrate immersed in the solvent is irradiated with deep-UV light.

Further features of the present invention will become apparent from the following description of exemplary embodiments with reference to the attached drawings.

DESCRIPTION OF THE EMBODIMENTS

In the method described in Japanese Patent Laid-Open No. 2006-150900, all high-molecular components in the mold are not turned into low-molecular components. As a result, when the solvent for removing the mold is repeatedly used, the high-molecular components derived from the mold accumulate in the solvent, and this sometimes makes it difficult to properly remove the mold. Further, the high-molecular components derived from the mold in the solvent are sometimes produced as residues near ink discharge ports and in a liquid chamber. If the residues are produced, stable discharging is sometimes difficult.

Figure 5:
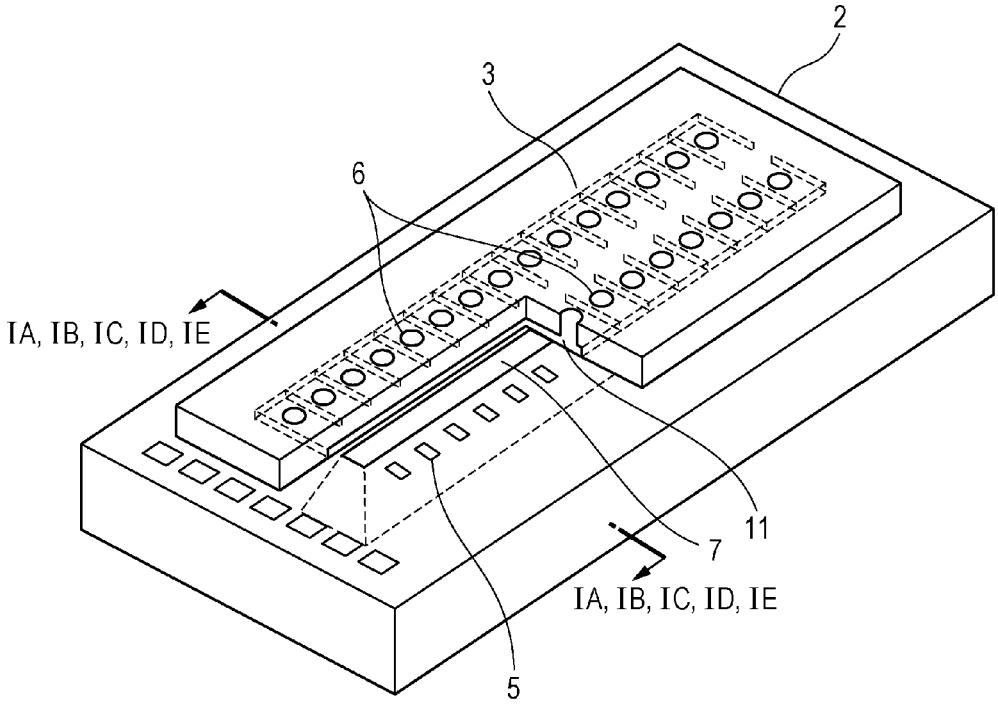
FIG. 5 illustrates an example of an inkjet recording head produced according to the embodiment of the present invention.

An embodiment of the present invention will be described in detail below. FIGS. 1A, 1B, 1C, 1D, and 1E are cross-sectional views taken along line IA-IA, IB-IB, IC-IC, ID-ID, and IE-IE of FIG. 5, respectively, illustrating a method for manufacturing an inkjet recording head according to the embodiment of the present invention. FIG. 5 illustrates an example of an inkjet recording head produced according to the embodiment of the present invention.

As illustrated in FIG. 5, the inkjet recording head includes a substrate 2 on which ink-discharge-energy generating elements 5 are arranged in two lines at a predetermined pitch. For example, the substrate 2 is formed of silicon. On the substrate 2, ink flow passages 11 and ink discharge ports 6 are formed by an orifice layer that serves as a flow passage forming member. The ink discharge ports 6 are open above the ink-discharge-energy generating elements 5. Further, an ink supply port 7 formed by, for example, anisotropic etching of silicon is open between the two lines of the ink-discharge-energy generating elements 5. The inkjet recording head performs recording by discharging ink droplets from the ink discharge ports 6 onto a recording medium, such as paper, while applying pressure generated by the ink-discharge-energy generating elements 5 to ink (liquid) filled in the ink flow passages 11 through the ink supply port 7.

Figure 1A:
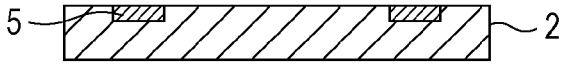
FIGS. 1A to 1E illustrate a method for manufacturing an inkjet recording head according to an embodiment of the present invention.

A method for manufacturing an inkjet recording head of the embodiment will be described with reference to FIGS. 1A to 1E. As illustrated in FIG. 1A, ink-discharge-energy generating elements 5 are provided on a surface of a substrate 2. Although not illustrated, lines and electrodes for driving the ink-discharge-energy generating elements 5 are also provided on the surface of the substrate 2.

First, a resin layer is formed on the substrate 2 by a coating method such as spin coating, direct coating, and spraying. The resin layer is formed of a positive sensitive resin. When the resin layer is irradiated with deep-UV light serving as ultraviolet light having a wavelength of 300 nm or less, molecular bonds in the resin layer are destroyed so that the resin layer can be dissolved in solvent.

Figure 1B:
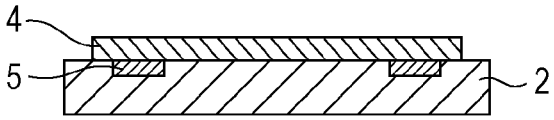

Next, as illustrated in FIG. 1B, the resin layer is irradiated with UV light and developed to become a mold 4 for ink passages 11. Preferably, the wavelength of the UV light is 250 nm or more, and more preferably, 260 nm or more. Also, preferably, the wavelength is 400 nm or less, and more preferably, 330 nm or less.

Figure 1C:
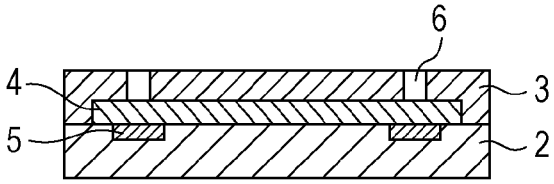

Next, as illustrated in FIG. 1C, liquid for forming an orifice layer is applied to cover the mold 4. Subsequently, portions corresponding to discharge ports are exposed, developed, and removed to form an orifice layer 3 having ink discharge ports 6. For example, the liquid for forming the orifice layer is applied by spin coating, direct coating, or spraying.

Figure 1D:
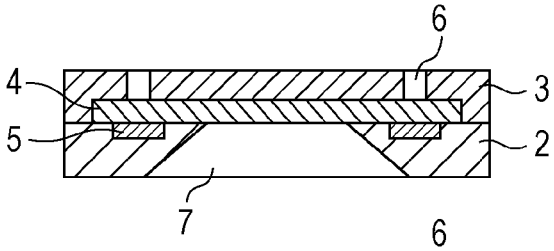

Next, as illustrated in FIG. 1D, an ink supply port 7 is formed in a surface of the substrate 2 opposite the surface on which the ink-discharge-energy generating elements 5 are provided. For example, the ink supply port 7 is formed by etching. Etching is anisotropic etching using a strong alkali solvent such as tetramethylammonium hydroxide (TMAH), potassium hydroxide (KOH), or sodium hydroxide (NaOH), or dry etching using gas.

Figure 1E:
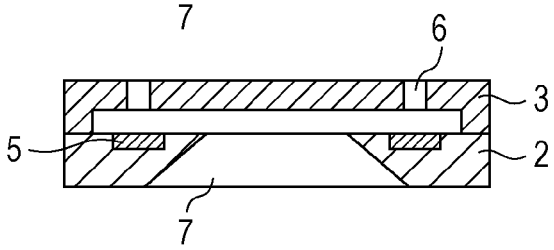
Figure 2:
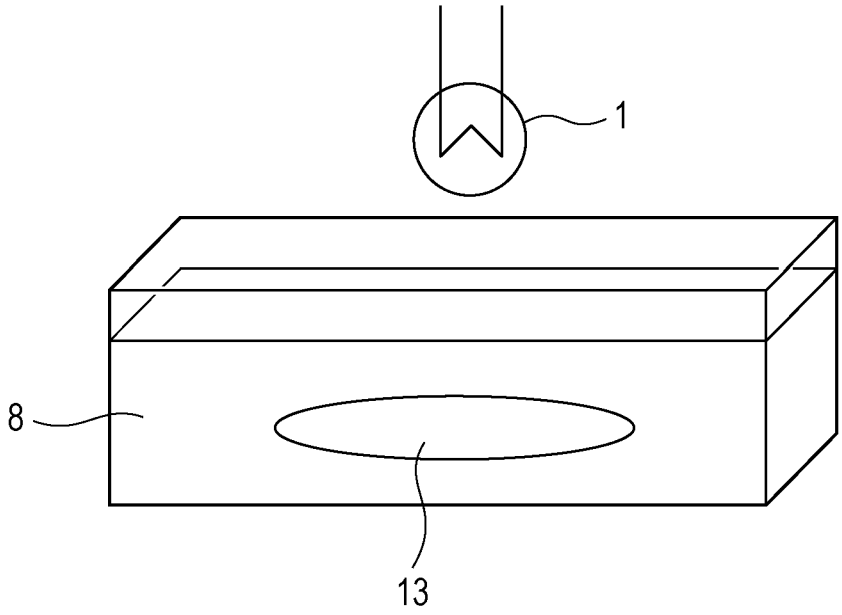
FIG. 2 illustrates a method for manufacturing an inkjet recording head according to the embodiment of the present invention.

Then, as illustrated in FIG. 1E, the mold 4 is removed from the substrate 2 by using solvent. In the embodiment of the present invention, the mold is removed by immersing the substrate having the mold in the solvent. The embodiment of the present invention is characterized in that the mold on the substrate is irradiated with deep-UV light at this time. More specifically, a method illustrated in FIG. 2 is performed. First, a wafer 13 formed by the substrate 2 having the mold 4 is immersed in solvent 8. In such a state in which the substrate 2 is immersed in the solvent 8, the mold 4 is irradiated with deep-UV light from a deep-UV lamp 1. The solvent 8 may be any solvent that can dissolve the mold 4, for example, methyl lactate, cyclohexanone, or acetone. The deep-UV light is preferably applied from an orifice layer 3 side of the substrate 2. By this method, the mold 4 can be removed by the solvent 8 while being irradiated with the deep-UV light. Even when high-molecular components derived from the mold 4 exist in the solvent 8, they can be turned into low molecular components in the solvent 8. Hence, the occurrence of residues in a liquid chamber or the like can be suppressed, and the solvent 8 can be repeatedly used (regenerated) for a long time.

The solvent may be subjected to batch treatment while being stored in a container, or may be subjected to continuous treatment while flowing constantly. Further, preferably, the output of the deep-UV lamp 1 is 5 watt or more, and more preferably, 200 watt or more. Also, preferably, the output of the deep-UV lamp 1 is 10000 watt or less, and more preferably, 5000 watt or less. A plurality of deep-UV lamps 1 may be used. Alternatively, a separate lamp that emits UV-B light having a wavelength of 300 nm or less may be used in combination. The temperature of the solvent is preferably higher than the room temperature (25° C.) for higher performance of removal of the mold. Further, the temperature of the solvent is preferably lower than or equal to the flash point of the solvent for ease of use.

While removal of the mold 4 using the solvent 8 and radiation of deep-UV light are simultaneously started in the above embodiment, they do not always need to be started simultaneously. For example, the substrate may be immersed in the solvent 8 and then irradiated with deep-UV light in this state. Conversely, the substrate may be irradiated with deep-UV light and then be immersed in the solvent 8 in this state.

While the mold 4 is removed after the ink supply port 7 is formed in the above embodiment, since the mold 4 can be removed from the ink discharge ports 6 after the ink discharge ports 6 are formed, the ink supply port 7 may be formed after the mold 4 is removed in this case. However, since the mold 4 can be removed more easily from the ink supply port 7 than from the ink discharge ports 6, it is preferably removed from the ink supply port 7 after the ink supply port 7 is formed.

Figure 3:
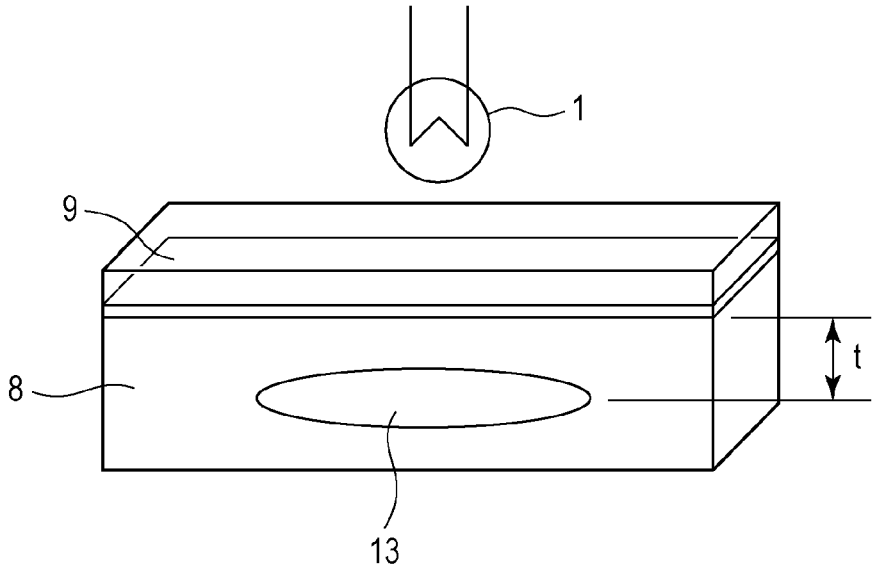
FIG. 3 illustrates a method for manufacturing an inkjet recording head according to the embodiment of the present invention.

In the embodiment of the present invention, as illustrated in FIG. 3, deep-UV light may be applied while an evaporation surface of the solvent 8 is covered with a quartz glass plate 9. This prevents evaporation of the solvent 8, and maintains a distance t between the substrate and the evaporation surface of the solvent 8. Hence, irradiation of the mold 4 with deep-UV light can be stabilized.

Figure 4:
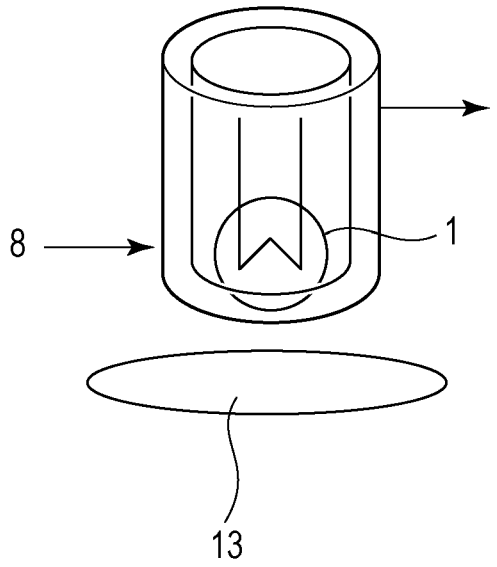
FIG. 4 illustrates an exemplary irradiation method using a deep-UV lamp.

Alternatively, as illustrated in FIG. 4, the solvent 8 may be subjected to regeneration treatment by circulating the solvent 8 around the deep-UV lamp 1 to decompose the resin into low molecules. In this case, it is also possible to simultaneously achieve both regeneration (decomposition into low molecules) of the solvent 8 by the application of deep-UV light and decomposition of the mold 4 in the wafer 13 into low molecules.

As described above, the inkjet recording head is produced according to the embodiment of the present invention.

EXAMPLES

The present invention will be more specifically described below in conjunction with examples.

First Example

A method for manufacturing an inkjet recording head will be described with reference to FIGS. 1A to 1E.

First, a substrate 2 formed of silicon was prepared (FIG. 1A). On a surface of the substrate 2, ink-discharge-energy generating elements 5 formed of TaSiN, and lines and electrodes (not illustrated) for applying voltage to the ink-discharge-energy generating elements 5 were provided. Also, a SiO film and a SiN film were formed by plasma CVD as insulating protective films that covered the ink-discharge-energy generating elements 5 and protected the electric wires from ink and other liquids.

A liquid in which polymethyl isopropenyl ketone (PMIPK) serving as a positive photosensitive resin was dissolved by a cyclohexanone solvent was applied onto the substrate 2 by spin coating. After that, a PMIPK film was formed by evaporating the cyclohexanone solvent, was irradiated with ultraviolet light by an exposure device, and was developed, so that a mold 4 for ink flow passages was formed from the resin layer (FIG. 1B).

Next, a liquid for forming an orifice layer was applied by spin coating to cover the mold 4. The liquid for forming the orifice layer was obtained by dissolving 100 parts by mass of epoxy resin EHPE3150 (trade name, manufactured by Daicel Chemical Industries, Ltd.) serving as a negative photosensitive resin and 6 parts by mass of a photocationic polymerization catalyst SP-172 (trade name, manufactured by Asahi Denka Co., Ltd.) by a xylene solvent. Subsequently, the xylene solvent was evaporated, and portions corresponding to discharge ports were exposed, developed, and removed by the exposure device, so that an orifice layer 3 including ink discharge ports 6 was formed (FIG. 1C).

Next, a back surface of the substrate 2 was subjected to anisotropic etching using a water solution of 22 percent by mass of tetramethylammonium hydroxide to form an ink supply port 7 (FIG. 1D).

Next, as illustrated in FIG. 2, deep-UV light was applied by the 5000-watt deep-UV lamp 1 from the orifice layer 3 side while a wafer formed by the substrate 2 including the mold 4 was immersed in a solvent 8 formed of methyl lactate and having a temperature of 40° C. The mold 4 was thereby decomposed into low molecules, and simultaneously, the mold 4 was eluted from the ink supply port 7 by the solvent 8.

A similar process was continuously performed for 2500 wafers (25 wafers×100 times). As a result, the solvent had a sufficient removability even in the hundredth process, and the mold was removed properly.

Comparative Example

In the above-described first example, removal of the mold 4 using the solvent 8 and irradiation of the mold 4 with the deep-UV light were performed as separate processes. A comparative example was similar to the first example except in that point.

More specifically, an ink supply port 7 was formed, and a mold 4 was then irradiated with deep-UV light in the air. After irradiation with deep-UV light was finished, a wafer formed by a substrate having the mold 4 was immersed in a solvent formed of methyl lactate and having a temperature of 40° C., so that the mold 4 was eluted.

A similar process was continuously performed for 250 wafers (25 wafers×10 times). As a result, the solvent had a sufficient removability even in the tenth process, and the mold was removed properly.

However, when the similar process was continuously performed for 300 wafers (25 wafers×12 times), the mold could not be properly removed in the twelfth process, and residues that were considered to be derived from the mold remained in ink flow passages.

According to the embodiment of the present invention, it is possible to provide a method for manufacturing an inkjet recording head, which allows the solvent to be repeatedly used for a long time and which restricts residues from being produced near ink discharge ports and in a liquid chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-232040 filed Oct. 21, 2011, which is hereby incorporated by reference herein in its entirety.

What is claimed is:

1. A method for manufacturing an inkjet recording head, comprising:

preparing a substrate having a mold and an orifice layer covering the mold; and immersing the substrate in a solvent to remove the mold from the substrate by dissolving the mold in the solvent, allowing an ink flow passage being formed, which is an area having the mold removed, wherein, in the step of immersing the substrate in the solvent, the mold at the substrate immersed in the solvent is irradiated with ultraviolet light having a wavelength of 300 nm or less to decompose the mold into low molecules.

2. A method for manufacturing an inkjet recording head according to claim 1, wherein, in the step of immersing the substrate in the solvent, the mold at the substrate is irradiated with the ultraviolet light while an evaporation surface of the solvent is covered to maintain a distance between the substrate and the evaporation surface of the solvent.

3. A method for manufacturing an inkjet recording head according to claim 1, wherein the mold is removed from the substrate by immersing the substrate in the solvent.

4. A method for manufacturing an inkjet recording head according to claim 1, wherein the solvent is at least any of methyl lactate, cyclohexanone, or acetone.

5. A method for manufacturing an inkjet recording head according to claim 1, wherein the ultraviolet light is emitted from a lamp and the solvent is subjected to regeneration treatment by being circulated around the ultraviolet light.

* * * * *